US012011133B2

(12) United States Patent
Gross

(10) Patent No.: US 12,011,133 B2
(45) Date of Patent: Jun. 18, 2024

(54) RETENTION CLIP FOR A CIRCUIT BOARD EDGE CONNECTOR

(71) Applicant: Haier US Appliance Solutions, Inc., Wilmington, DE (US)

(72) Inventor: Michelle Diana Gross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 402 days.

(21) Appl. No.: 17/352,509

(22) Filed: Jun. 21, 2021

(65) Prior Publication Data

US 2022/0400928 A1 Dec. 22, 2022

(51) Int. Cl.
*A47L 15/42* (2006.01)
*A47L 15/46* (2006.01)

(52) U.S. Cl.
CPC ..... *A47L 15/4274* (2013.01); *A47L 15/46* (2013.01); *A47L 15/4293* (2013.01)

(58) Field of Classification Search
CPC ... A47L 15/4293; A47L 15/4274; A47L 15/46
See application file for complete search history.

(56) References Cited

U.S. PATENT DOCUMENTS 5,031,074 A 7/1991 Ravid
7,500,867 B1 3/2009 Doglio
9,444,188 B2 9/2016 Cox
2007/0257893 A1* 11/2007 Philipp ..... G06F 3/045 345/173
2012/0252246 A1* 10/2012 Cox ..... H01R 13/64 439/259
2013/0021131 A1* 1/2013 Fitzpatrick ..... H01H 85/04 337/297
2022/0151457 A1* 5/2022 Gross ..... A47L 15/4274

FOREIGN PATENT DOCUMENTS

EP 0840408 B1 5/2003
EP 1358837 A2 * 11/2003 ..... A47L 15/0086
EP 2390577 A1 * 11/2011 ..... A47J 37/1266
EP 4067794 A1 * 10/2022
WO WO-2005061776 A1 * 7/2005 ..... A47L 15/4217

OTHER PUBLICATIONS

Machine translation of WO 2005061776 A1 to Rosenbauer et al., Jul. 2005. (Year: 2005).*

* cited by examiner

*Primary Examiner* — Benjamin L Osterhout
(74) *Attorney, Agent, or Firm* — Dority & Manning, P.A.

(57) ABSTRACT

A console base for an appliance holding a circuit board includes a clip for holding an edge connector in place during operation of the appliance. The console base includes a connector support structure including a resilient tab allowing selective connection and release of the connector without disassembly of the appliance.

20 Claims, 5 Drawing Sheets

RETENTION CLIP FOR A CIRCUIT BOARD EDGE CONNECTOR

FIELD OF THE INVENTION

The present subject matter relates generally to PCB connectors for appliances, and more particularly to latching mechanisms for PCB edge connectors.

BACKGROUND OF THE INVENTION

Conventional appliances, such as dishwashers, refrigerators, laundry appliances, and the like increasingly incorporate electronic equipment into fabrication for improved operability and user convenience. Such electronic equipment may include circuit boards (such as printed circuit boards (PCBs), for instance) attached to particular framework of the appliance. These circuit boards may have various connectors attached thereto to allow electronic communication between the circuit board(s) and other interactive or operational equipment within the appliance. For instance, a wire may be connected to an edge of the circuit board and fed through the framework of the appliance to various sensors or displays.

Assembly and maintenance of such circuit boards (and electronic assemblies) may require occasional disconnection of the wires from the circuit board. Conventionally, an assembler must attach the wiring connector to the circuit board before attaching the circuit board to the framework of the appliance. The wiring must then be fed through a cover over the circuit board to be attached to a corresponding sensor, for example. Additionally or alternatively, to remove or replace the connector, a worker must fully remove the cover to access and unplug the connector, increasing time and effort as well as the potential for damage to the circuit board, the connector, or the appliance.

Accordingly, a retention clip for an edge connector that obviates one or more of the above-mentioned drawbacks would be beneficial. In particular, a retention clip that allows easy attachment and detachment of an edge connector would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a console base is provided. The console base may secure a control board within an appliance. The console base may define a vertical direction, a lateral direction, and a transverse direction. The console base may include a base plate extending along the lateral direction and the transverse direction; a plurality of board mounting clips extending along the vertical direction from the base plate and defining a pocket for securing the control board to the base plate; and a connector support structure extending along the vertical direction from the base plate adjacent to the plurality of board mounting clips. The connector support structure may include a connector body defining a receiving slot; a resilient snap tab extending along the lateral direction from the connector body; and a retention piece protruding from the snap tab.

In another exemplary aspect of the present disclosure, a dishwasher appliance is disclosed. The dishwasher appliance may define a vertical direction, a lateral direction, and a transverse direction. The dishwasher appliance may include a cabinet forming a wash chamber; a door pivotally attached to the cabinet for providing selective access to the wash chamber; a console base for securing a control board within the dishwasher appliance, and a connector support structure extending along the vertical direction from the base plate adjacent to the plurality of board mounting clips. The console base may include a base plate extending along the lateral direction and the transverse direction; a plurality of board mounting clips extending along the vertical direction from the base plate and defining a pocket for securing the control board to the base plate. The connector support structure may include a connector body defining a receiving slot; a resilient snap tab extending along the lateral direction from the connector body; and a retention piece protruding from the snap tab.

In another exemplary embodiment of the present disclosure, a user interface console assembly is disclosed. The user interface console assembly may define a vertical direction, a lateral direction, and a transverse direction. The user interface console assembly may include a console base, and a bracket detachably coupled to the console base. The console base may include a base plate extending along the lateral direction and the transverse direction; a plurality of board mounting clips extending along the vertical direction from the base plate and defining a pocket for securing a control board to the base plate; and a connector support structure extending along the vertical direction from the base plate adjacent to the plurality of board mounting clips. The connector support structure may include a connector body defining a receiving slot; a resilient snap tab extending along the lateral direction from the connector body; and a retention piece protruding from the snap tab. The control board may be provided between the console base and the bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
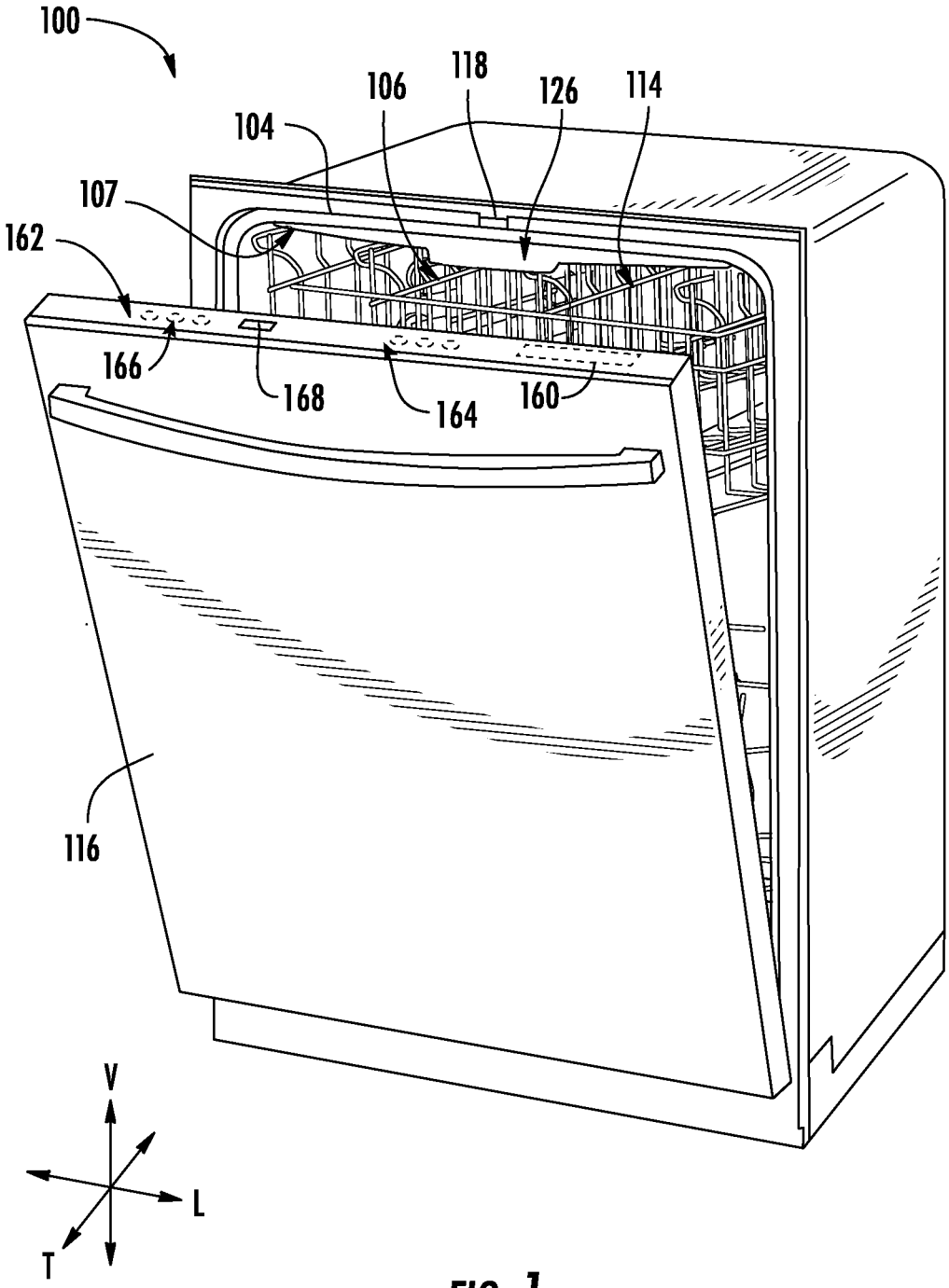
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
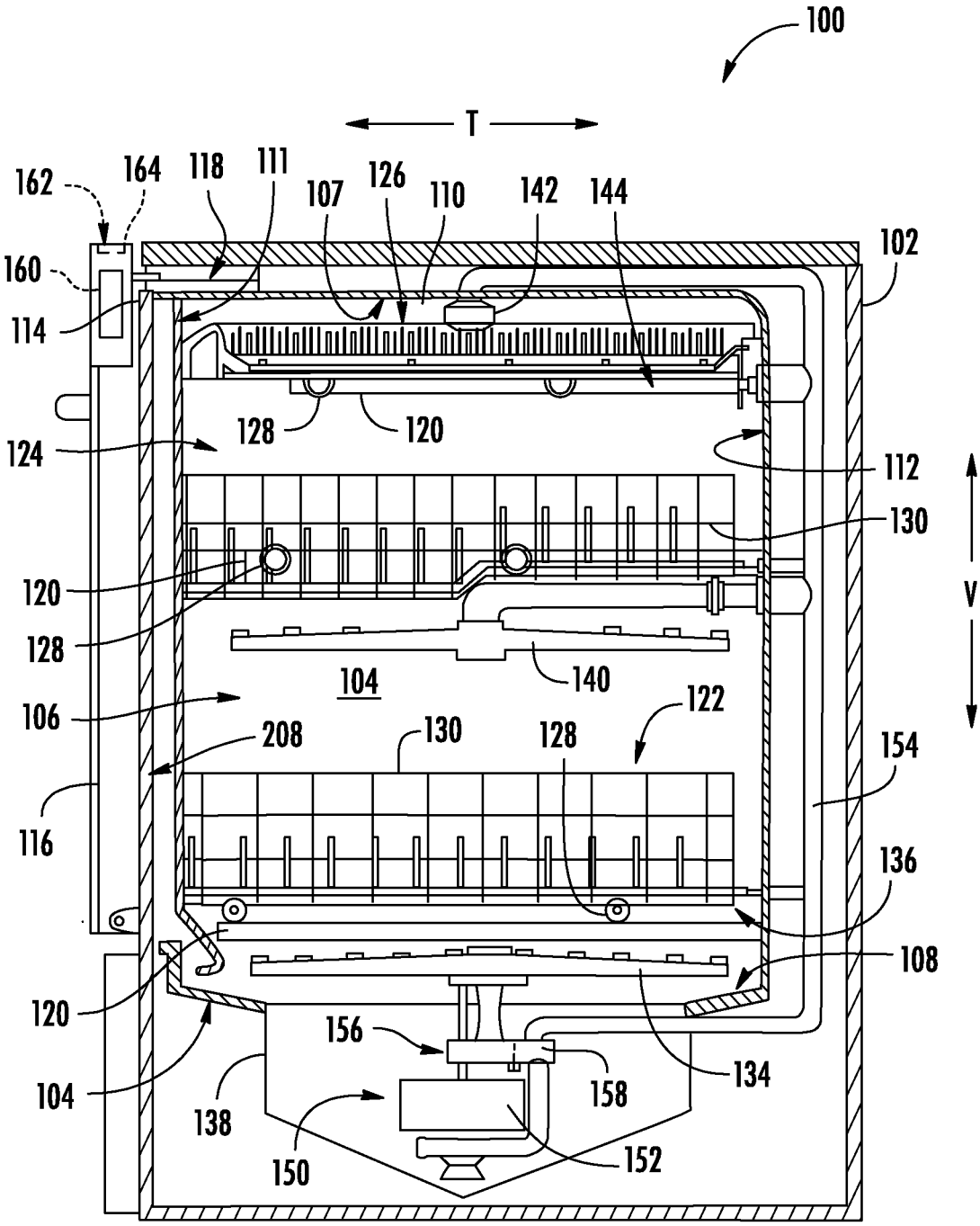
FIG. 2 provides a cross-sectional side view of the exemplary dishwashing appliance of FIG. 1.
Figure 3:
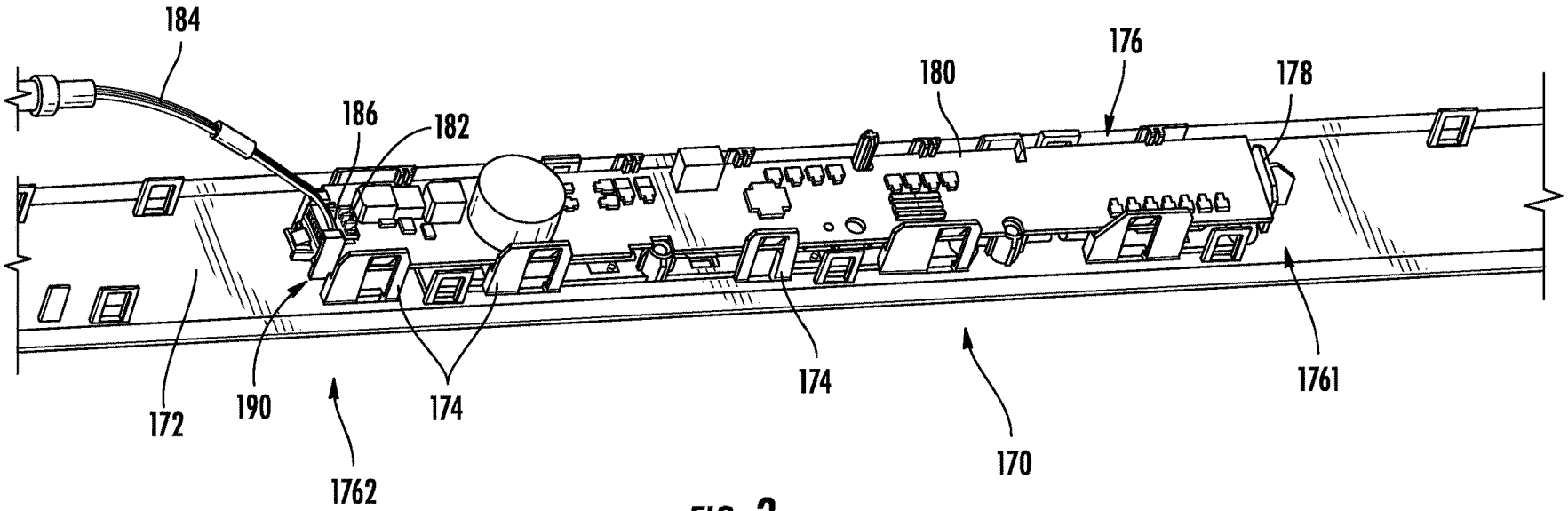
FIG. 3 provides a perspective view of a console base of the exemplary dishwasher appliance of FIG. 1, including a circuit board according to exemplary embodiments of the present disclosure.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now to FIGS. 3 through 6, a console base 170 for user interface 164 will be described in detail. Console base 170 is merely an exemplary embodiment of the disclosure, and it should be understood that the structures described with respect to console base 170 may be incorporated into any bracket or base configured to hold a board having wire attachments, such as a Printed Circuit Board (PCB). For instance, console base 170 may be used to hold a user interface board (e.g., user interface panel 164), a main control board, an operations board, a light board, or the like. Additionally or alternatively, the terms "coupled," "fixed," "attached to," and the like refer to both direct coupling, fixing, or attaching, as well as indirect coupling, fixing, or attaching through one or more intermediate components or features, unless otherwise specified herein.

Console base 170 may include a base plate 172. In some embodiments, base plate 172 defines a top edge of door 116. However, the disclosure is not limited to this, and base plate 172 may be provided in any suitable location on or in dishwasher appliance 100. For another example, base plate 172 may define part of a front surface of door 116. Additionally or alternatively, base plate 172 is not limited to the size or shape shown in FIG. 3. Console base 170 may include a plurality of board mounting clips 174. Each of the plurality of board mounting clips 174 may extend from base plate 172, e.g., along the vertical direction V. For instance, board mounting clips 174 may be integral with base plate 172, such that base plate 172 and board mounting clips 174 are molded together as one piece. The plurality of board mounting clips 174 may be spaced apart from each other. Accordingly, the plurality of board mounting clips 174 may define a pocket 176 into which a control board 180 (e.g., user interface panel 164) is received. The plurality of board mounting clips 174 may include a stabilizing tab 178. Stabilizing tab 178 may be provided at one end of pocket 176 (e.g., along the lateral direction L). Stabilizing tab 178 may be located so as to abut against a lateral edge of control board 180 when control board 180 is within pocket 176. Accordingly, stabilizing tab 178 may restrict movement of control board 180 along the lateral direction.

As discussed above, control board 180 may be user interface panel 164. In some embodiments, control board 180 is a main control board (containing various electronic equipment, sensors, lights, etc.). Control board 180 may include an edge connector outlet 182. In detail, edge connector outlet 182 may be located at or near an edge of control board 180 (e.g., along the lateral direction L or the transverse direction T). Edge connector outlet 182 may be configured to accept a wire connection from an external source. For instance, a wire 184 including a connector 186 may be plugged into edge connector outlet 182 in either the lateral direction L or the transverse direction T (e.g., a direction parallel to control board 180 and console base 170). Edge connector outlet 182 may be located opposite stabilizing tab 178 (e.g., when control board 180 is inserted into pocket 176). Accordingly, when connector 186 is plugged into edge connector outlet 182, control board 180 is restrained from moving away from wire 184, and a proper connection may be assured.

Console base 170 may include a connector support structure 190. Connector support structure 190 may protrude from console base 170 along the vertical direction V and may be provided adjacent to the plurality of board mounting clips 174. For instance, connector support structure 190 may be integral with base plate 172, such that base plate 172 and connector support structure 190 are molded together as one piece. In detail, connector support structure 190 may be provided opposite stabilizing tab 178. For instance, stabilizing tab 178 may be located at a first lateral end 1761 of pocket 176, and connector support structure 190 may be located at a second lateral end 1762 of pocket 176. Thus, control board 180 may be provided between stabilizing tab 178 and connector support structure 190.

Connector support structure 190 may include a connector body 192. Connector body 192 may define a receiving slot 193. Receiving slot 193 may be shaped complimentary to connector 186 of wire 184. Accordingly, connector support structure 190 may restrain connector 186, e.g., along the transverse direction T and along the vertical direction V. Connector body 192 may include a first support tab 194, a second support tab 196, a first lip 198, and a second lip 199. In detail, first support tab 194 may protrude along the vertical direction V from base plate 172. First support tab 194 may protrude to a predetermined distance so as to accommodate connector 186 when wire 184 is plugged into edge connector outlet 182.

Second support tab 196 may protrude along the vertical direction V from base plate 172. Second support tab 196 may protrude to a predetermined distance so as to accommodate connector 186 when wire 184 is plugged into edge connector outlet 182. Second support tab 196 may be opposite first support tab 194 (e.g., along the transverse direction T), having receiving slot 193 defined therebetween. Accordingly, connector 186 may be restrained along the transverse direction T between first support tab 194 and second support tab 196.

First lip 198 may extend from a distal end 1941 of first support tab 194. In detail, first lip 198 may extend toward second support tab 196 along the transverse direction T. An extending length (e.g., along the transverse direction T) of first lip 198 may vary according to specific embodiments. For instance, an extending distance of first lip 198 may be between about 10% and about 20% of the length of first support tab 194 (e.g., along the transverse direction). Second lip 199 may extend from a distal end 1961 of second support tab 196. In detail, second lip 199 may extend toward first support tab 194 along the transverse direction T. An extending length (e.g., along the transverse direction T) of second lip 199 may vary according to specific embodiments. For instance, an extending distance of second lip 199 may be between about 10% and about 20% of the length of second support tab 196 (e.g., along the transverse direction T). Accordingly, a gap may be formed between first lip 198 and second lip 199 (e.g., to accommodate wire 184). In alternate embodiments, first lip 198 and second lip 199 connect with each other (e.g., along the transverse direction T) providing a single unitary piece between first support tab 194 and second support tab 196. Additionally or alternatively, first lip 198 and second lip 199 may restrain a movement of connector 186 along the vertical direction V (e.g., away from base plate 172). First lip 198 and second lip 199 may be predominantly parallel to base plate 172.

Connector body 192 may further include a connecting tab 197 connecting first tab 194 to second tab 196. In detail, connecting tab 197 may extend from base plate 172 along the vertical direction V and along the transverse direction T. A protruding length (e.g., from base plate 172) may be less than the extending length of each of the first support tab 194 and the second support tab 196. A protruding length of connecting tab 197 may be equal to a vertical location of control board 180 when control board 180 is secured within pocket 176. Thus, the top edge of connecting tab 197 may abut control board 180 so as to be predominantly flush with control board 180.

A resilient snap tab 200 may extend from connector body 192 along the lateral direction L. In detail, snap tab 200 may extend from connecting tab 197 along the lateral direction L. Snap tab 200 may extend away from pocket 176 along the lateral direction L. As seen particularly in FIG. 4, snap tab 200 may be located between first support tab 194 and second support tab 196 along the transverse direction T. Further, a distal end 2001 of snap tab 200 may be located further away from pocket 176 than first support tab 194 and second support tab 196. For instance, distal end 2001 of snap tab 200 may be located further from pocket 176 along the lateral direction L than an outer lateral edge 1941 of first support tab 194 and an outer lateral edge 1961 of second support tab 196. Accordingly, distal end 2001 of snap tab may extend laterally outside of receiving slot 193.

Snap tab 200 may be predominantly parallel to base plate 172. Additionally or alternatively, snap tab 200 may be predominantly parallel to first lip 198 and second lip 199. In detail, when snap tab 200 is at a neutral or rest position, snap tab 200 may be parallel with base plate 172. When a force is applied to distal end 2001 of resilient snap tab 200 (e.g., along the vertical direction V), distal end 2001 may be depressed lower than the top edge of connecting tab 197. When the force applied to distal end 2001 is removed, snap tab 200 may return to the neutral position. In one example, distal end 2001 is depressed downward when connector 186 is pressed into receiving slot 193. One connector 186 is fully inserted, snap tab 200 may return to the neutral position. Thus, snap tab 200 may flex (or be resilient) in the vertical direction V. It should be understood that the orientations used herein are by example only, and that the coordinate system (vertical V, lateral L, transverse T) may be altered according to specific embodiments.

Figure 4:
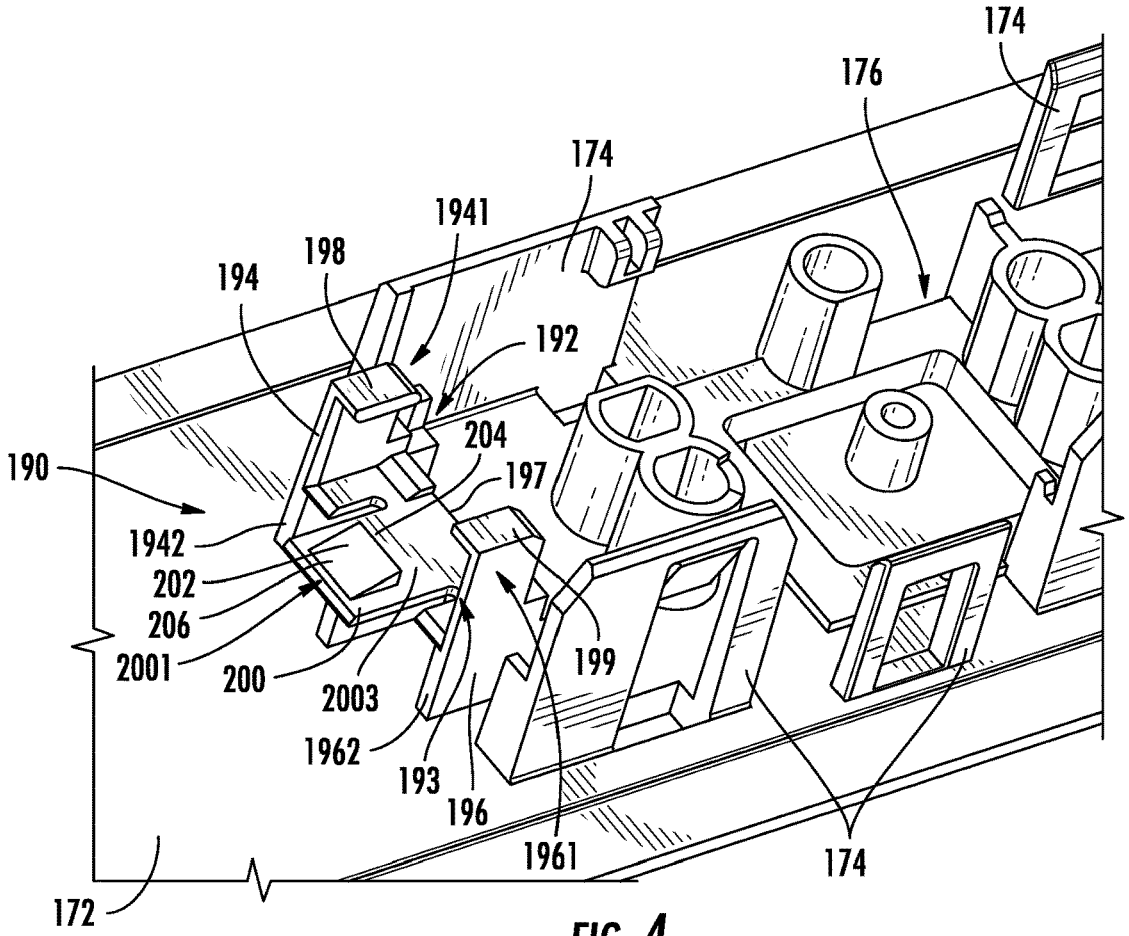
FIG. 4 provides a close-up perspective view of a connector brace of the exemplary console base of FIG. 3.
Figure 5:
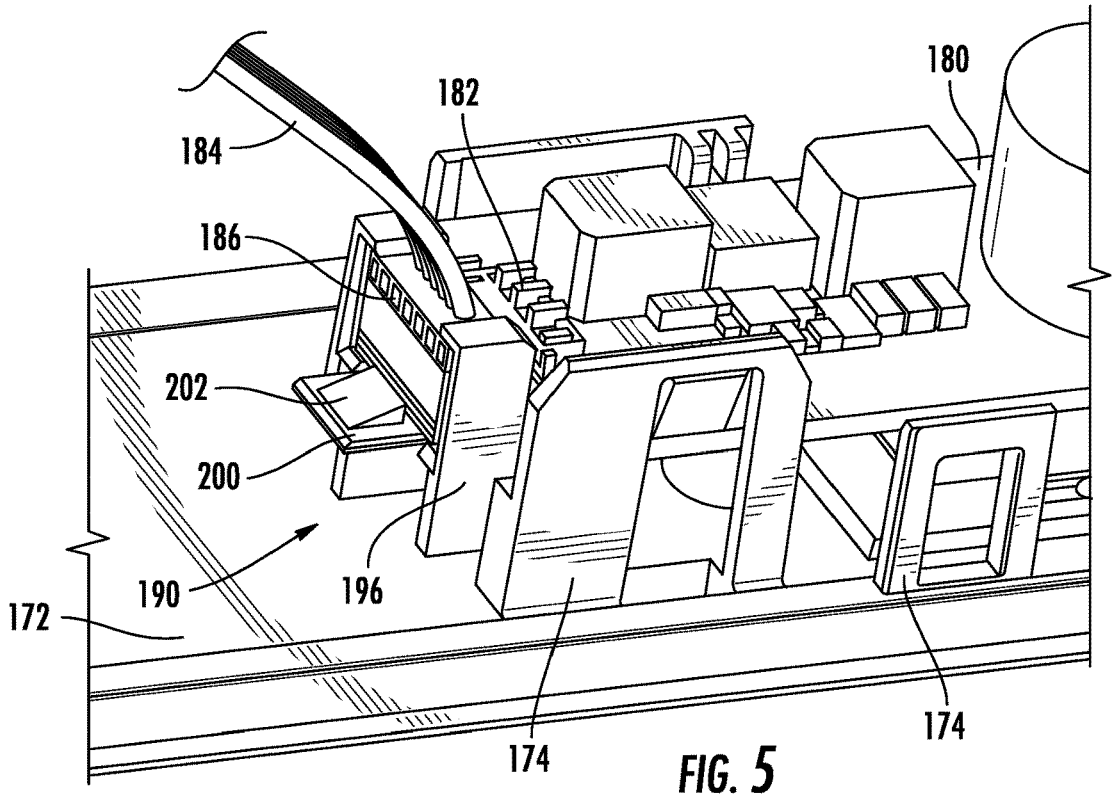
FIG. 5 provides a close-up perspective view of the connector brace of FIG. 3 with an edge connector attached.

Resilient snap tab 200 may include a retention piece 202. In detail, retention piece 202 may protrude from a press face 2003 of snap tab 200. Press face 2003 may be a top face of snap tab 200, as illustrated in FIG. 4. However, as discussed above, press face 2003 may be orientated in any suitable direction according to specific embodiments. With specific reference to FIG. 4, retention piece 202 may protrude in the vertical direction V (e.g., away from base plate 172). Retention piece 202 may have a wedge shape. In detail, a proximal edge 204 of retention piece 202 may extend further from snap tab 200 than distal edge 206 (e.g., in the vertical direction V). For reference, distal edge 206 may be adjacent distal end 2001 of snap tab 200.

Additionally or alternatively, proximal edge 204 may be located in a plane (e.g., defined in the vertical direction V and the transverse direction T) that is aligned with outer lateral edge 1942 of first support tab 194 and outer lateral edge 1962 of second support tab 196. However, in some embodiments, proximal edge 204 may be laterally inward or outward from the plane aligned with outer lateral edge 1942 of first support tab 194 and outer lateral edge 1962 of second support tab 196. Advantageously, returning to the above-mentioned example, proximal edge 204 may abut connector 186 when connector 186 is inserted (e.g., plugged) into control board 180, specifically, edge connector outlet 182. As snap tab 200 returns to the neutral position, retention piece may abut connector 186 along the lateral direction L. With control board 180 abutted against stabilizing tab 178 and connector 186 abutted against proximal edge 204 of retention piece 202, connector 186 may be fully supported along the lateral direction L in its connection to control board 180. Further, connector 186 may be fully supported along the vertical direction V by first lip 198 and second lip 199, as well as connecting tab 197. Further still, connector 186 may be fully supported along the transverse direction T by first support tab 194 and second support tab 196.

Figure 6:
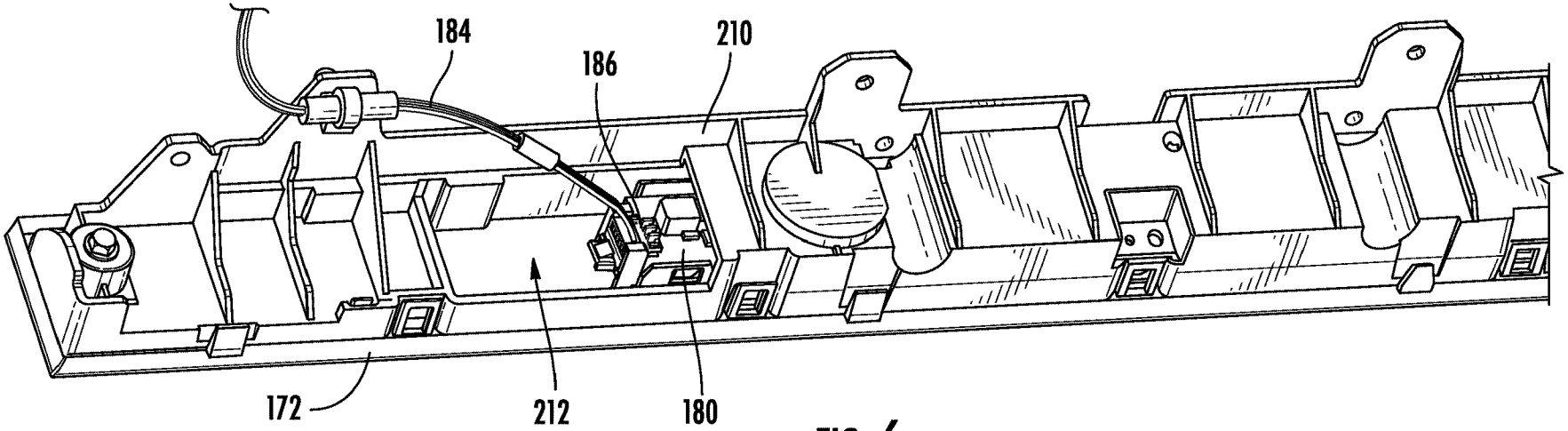
FIG. 6 provides a perspective view of the console base of FIG. 3, including a cover bracket according to exemplary embodiments of the present disclosure.

Referring now to FIG. 6, a bracket (or bracket cover) 210 may be included to cover control board 180. Bracket 210 may be detachably coupled to console base 170 (e.g., base plate 172). Control board 180 may be provided between base plate 172 and bracket 210. For instance, bracket 210 may be coupled to console base 170 via snaps, fasteners, adhesives, pins, or the like. Bracket 210 may define a through hole 212. Through hole 212 may be defined through bracket 210 along the vertical direction V. Through hole 212 may be located at or near edge connector outlet 182 of control board 180. Accordingly, wire 184 may be fed through through hole 212 and attached to edge connector outlet 182. Advantageously, through hole 212 may have a limited area, increasing the strength and rigidity of bracket 210. Additionally or alternatively, connector 186 may be attached to edge connector outlet 182 after bracket 210 is coupled to console base 170, resulting in reduced assembly time and increased stability. Together with connector support structure 190 described above, connector 186 (and wire 184) may be easily connected to and disconnected from edge connector outlet 182 without removing bracket 210 and may remain connected through use of the appliance.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A console base for securing a control board within an appliance, the console base defining a vertical direction, a lateral direction, and a transverse direction, the console base comprising:

a base plate extending along the lateral direction and the transverse direction;

a plurality of board mounting clips extending along the vertical direction from the base plate and defining a pocket for securing the control board to the base plate; and a connector support structure extending along the vertical direction from the base plate adjacent to the plurality of board mounting clips, the connector support structure comprising:

a connector body defining a receiving slot;

a resilient snap tab extending along the lateral direction from the connector body; and a retention piece protruding from the snap tab.

2. The console base of claim 1, wherein the snap tab is parallel to the base plate when the snap tab is in a neutral position, and the retention piece protrudes along the vertical direction.

3. The console base of claim 2, wherein the connector body comprises:

a first support tab extending along the vertical direction from the base plate and located on a first transverse side of the snap tab;

a second support tab extending along the vertical direction from the base plate and located on a second transverse side of the snap tab;

a first lip extending along the transverse direction from a distal end of the first support tab, the first lip extending toward the second support tab; and a second lip extending along the transverse direction from a distal end of the second support tab, the second lip extending toward the first support tab.

4. The console base of claim 3, wherein a distal end of the snap tab is located further away from the pocket along the lateral direction than an outer lateral edge of the first support tab and an outer lateral edge of the second support tab.

5. The console base of claim 3, wherein the first lip and the second lip are parallel to the snap tab and spaced apart from the snap tab a predetermined distance in the vertical direction.

6. The console base of claim 1, wherein the retention piece is a wedge having a proximal edge extending further from the snap tab than a distal edge.

7. The console base of claim 1, wherein the control board is a printed circuit board comprising an edge connector outlet, and wherein the edge connector outlet is arranged proximate the connector support structure.

8. The console base of claim 7, wherein the printed circuit board is a user interface board within a user interface console of the appliance.

9. The console base of claim 1, wherein the plurality of board mounting clips comprises a stabilizing tab, the stabilizing tab being located opposite the connector support structure.

10. The console base of claim 1, wherein the appliance is a dishwasher.

11. A dishwasher appliance defining a vertical direction, a lateral direction, and a transverse direction, the dishwasher appliance comprising:

a cabinet forming a wash chamber;

a door pivotally attached to the cabinet for providing selective access to the wash chamber;

a console base for securing a control board within the dishwasher appliance, wherein the console base comprises:

a base plate extending along the lateral direction and the transverse direction;

a plurality of board mounting clips extending along the vertical direction from the base plate and defining a pocket for securing the control board to the base plate; and a connector support structure extending along the vertical direction from the base plate adjacent to the plurality of board mounting clips, the connector support structure comprising:

a connector body defining a receiving slot;

a resilient snap tab extending along the lateral direction from the connector body; and a retention piece protruding from the snap tab.

12. The dishwasher appliance of claim 11, wherein the snap tab is parallel to the base plate when the snap tab is in a neutral position, and the retention piece protrudes along the vertical direction.

13. The dishwasher appliance of claim 12, wherein the connector body comprises:

a first support tab extending along the vertical direction from the base plate and located on a first transverse side of the snap tab;

a second support tab extending along the vertical direction from the base plate and located on a second transverse side of the snap tab;

a first lip extending along the transverse direction from a distal end of the first support tab, the first lip extending toward the second support tab; and a second lip extending along the transverse direction from a distal end of the second support tab, the second lip extending toward the first support tab.

14. The dishwasher appliance of claim 13, wherein a distal end of the snap tab is located further away from the pocket along the lateral direction than an outer lateral edge of the first support tab and an outer lateral edge of the second support tab.

15. The dishwasher appliance of claim 13, wherein the first lip and the second lip are parallel to the snap tab and spaced apart from the snap tab a predetermined distance in the vertical direction.

16. The dishwasher appliance of claim 11, wherein the retention piece is a wedge having a proximal edge extending further from the snap tab than a distal edge.

17. The dishwasher appliance of claim 11, wherein the control board is a printed circuit board comprising an edge connector outlet, and wherein the edge connector outlet is arranged proximate the connector support structure.

18. The dishwasher appliance of claim 17, wherein the printed circuit board is a user interface board within a user interface console.

19. A user interface console assembly, the user interface console assembly defining a vertical direction, a lateral direction, and a transverse direction, the user interface console assembly comprising:

a console base comprising:

a base plate extending along the lateral direction and the transverse direction;

a plurality of board mounting clips extending along the vertical direction from the base plate and defining a pocket for securing a control board to the base plate; and a connector support structure extending along the vertical direction from the base plate adjacent to the plurality of board mounting clips, the connector support structure comprising:

a connector body defining a receiving slot;

a resilient snap tab extending along the lateral direction from the connector body; and a retention piece protruding from the snap tab; and a bracket detachably coupled to the console base, wherein the control board is provided between the console base and the bracket.

20. The user interface console assembly of claim 19, wherein the bracket defines a through hole adjacent to the connector support structure.

* * * * *